United States Patent [19]

Ohgami et al.

[11] 4,386,592

[45] Jun. 7, 1983

[54] AIR-FUEL RATIO CONTROL SYSTEM

[75] Inventors: Masaaki Ohgami; Fujio Matsui, both of Musashino, Japan

[73] Assignees: Fuji Jukogyo Kabushiki Kaisha, Tokyo; Nissan Motor Co., Ltd., Yokohama, both of Japan

[21] Appl. No.: 231,557

[22] Filed: Feb. 4, 1981

[30] Foreign Application Priority Data

Feb. 6, 1980 [JP] Japan ..... 55-13240

[51] Int. Cl.[3] ..... F02B 3/00; F02M 7/12; F02B 3/10; F02D 35/00

[52] U.S. Cl. ..... 123/440; 123/489

[58] Field of Search ..... 123/440, 438, 434, 443, 123/489; 60/276, 285

[56] References Cited

U.S. PATENT DOCUMENTS

| | | | |
|---|---|---|---|
| 3,875,907 | 4/1975 | Wessel et al. | 123/440 |
| 4,103,695 | 8/1978 | Aono | 123/440 |
| 4,121,547 | 10/1978 | Asano | 123/440 |
| 4,320,730 | 3/1982 | Takada et al. | 123/440 |

OTHER PUBLICATIONS

Oldenburger Papar "Signal Stabilization of a Control System", ASME vol. '79, 1957, pp. 527-542.

*Primary Examiner*—Raymond A. Nelli
*Attorney, Agent, or Firm*—Martin A. Farber

[57] ABSTRACT

An air-fuel ratio control system for an internal combustion engine having an intake passage, an exhaust passage, air-fuel mixture supply unit, on-off type electromagnetic valve for correcting the air-fuel ratio of the air-fuel mixture supplied by the air-fuel mixture supply unit, a dither signal generating circuit for producing a periodical dither signal having a waveform, a shift control circuit for shifting the level of the center of the dither signal, a driving circuit for producing a driving output according to the dither signal, and detecting means for detecting the concentration of oxygen in exhaust gases passing through the exhaust passage. The system is provided with a memory circuit unit for memorizing a peak level of output of the detecting circuit and for producing an output according to the memorized peak level, first circuit being applied with outputs of the detector and of the memory circuit for detecting deviation of the dither signal detected by the detector. A decision circuit is responsive to outputs of the first circuit for producing an output representing direction and amount of the deviation of the detected dither signal from the stoichiometric air-fuel ratio, and a second circuit responsive to the decision circuit output for providing dependent thereon a shifting amount for shifting the dither signal via the shift control circuit such that the deviation of the dither signal is corrected to the stoichiometric air-fuel ratio.

5 Claims, 15 Drawing Figures

AIR-FUEL RATIO CONTROL SYSTEM

BACKGROUND OF THE INVENTION

The present invention relates to a system for controlling the air-fuel ratio for an internal combustion engine emission control system having a three-way catalyst, and more particularly to a system for controlling the air-fuel ratio to a value approximating the stoichiometric air-fuel ratio so as to effectively operate the three-way catalyst.

Such a system is a feedback control system, in which an oxygen sensor is provided to sense the oxygen content of the exhaust gases to generate an electrical signal as an indication of the air-fuel ratio of the air-fuel mixture supplied by a carburetor. The control system comprises a comparator for comparing the output signal of the oxygen sensor with a predetermined value, an integrating circuit connected to the comparator, a driving circuit for producing square wave pulses from the output signal of the integrating circuit, and an on-off type electromagnetic valve for correcting the air-fuel ratio of the mixture. The control system operates to determine whether the feedback signal from the oxygen sensor is higher or lower than a predetermined reference value corresponding to the stoichiometric air-fuel ratio for producing an error signal for actuating the on-off type electromagnetic valve so as to control the air-fuel ratio of the mixture.

The response of such a feedback control system is inherently slow because the time of detection by the oxygen sensor is delayed. More particularly, the mixture that is corrected by the on-off type electromagnetic valve is induced in the cylinders of the engine passing through the induction passage and burned therein, and thereafter discharged into the exhaust passage. Therefore, by the time the oxygen sensor detects the oxygen content of the exhaust gases based on the corrected mixture, the corrective action with the on-off electromagnetic valve has overshot the desired point. As a result, a rich or lean mixture caused by the overshooting is induced in the engine and the deviation of the air-fuel ratio is detected by the oxygen sensor. Thus, a corrective action in the opposite direction will be initiated. After such an oscillation of the control operation, the variation of the air-fuel ratio of the mixture will converge toward the stoichiometric ratio. Therefore, the deviation of the air-fuel ratio of the mixture is corrected to the stoichiometric ratio with some delay. Consequently, the desired reduction of the harmful constituents may not be achieved.

Japanese Patent Application No. 54-98853 (U.S. Patent application No. 174,385 filed on Aug. 1, 1980, not prior art, but the disclosure thereof being incorporated by reference herein) discloses a system intended for improvement of such a control delay, in which the oscillation center of a dither wave signal detected by the oxygen sensor is shifted according to the deviation of the output signal of the oxygen sensor for correcting the air-fuel ratio. However, when the engine is rapidly accelerated or decelerated, the correcting operation is delayed even in such a system.

SUMMARY OF THE INVENTION

An object of the present invention is to provide a control system in which the amount of shifting of the dither wave signal is varied with the variation of the engine operation in the transient state, such that the deviation of the air-fuel ratio from the desired value may be quickly corrected.

According to the present invention, there is provided a dither signal generating circuit, a shift control circuit for shifting the level of the dither signal, a driving circuit for driving an electromagnetic valve to correct the air-fuel ratio of the air-fuel mixture suppled to the engine, a detecting means for detecting oxygen concentration in the exhaust passage, a memory circuit means for memorizing a peak level of output of said detecting means and for producing an output according to the memorized peak level, first circuit means being applied with outputs of said detecting means and of said memory circuit means for detecting deviation of the dither signal detected by said detecting means, decision circuit means responsive to outputs of said first circuit means for producing an output representing direction and amount of deviation of the detected dither signal from the stoichiometric air-fuel ratio, and second circuit means responsive to said output of said decision circuit means for providing dependent thereon a magnitude and direction for shifting of the dither signal by said shift control circuit such that the deviation of said dither signal is corrected to the stoichiometric air-fuel ratio.

Other objects and feature of the present invention will be apparent from the following description with reference to the accompanying drawings.

FIGS. *7a* and *7b* show an example of the electronic control circuit.

DETAILED DESCRIPTION OF THE PREFERRED EMBODIMENTS

Figure 1:
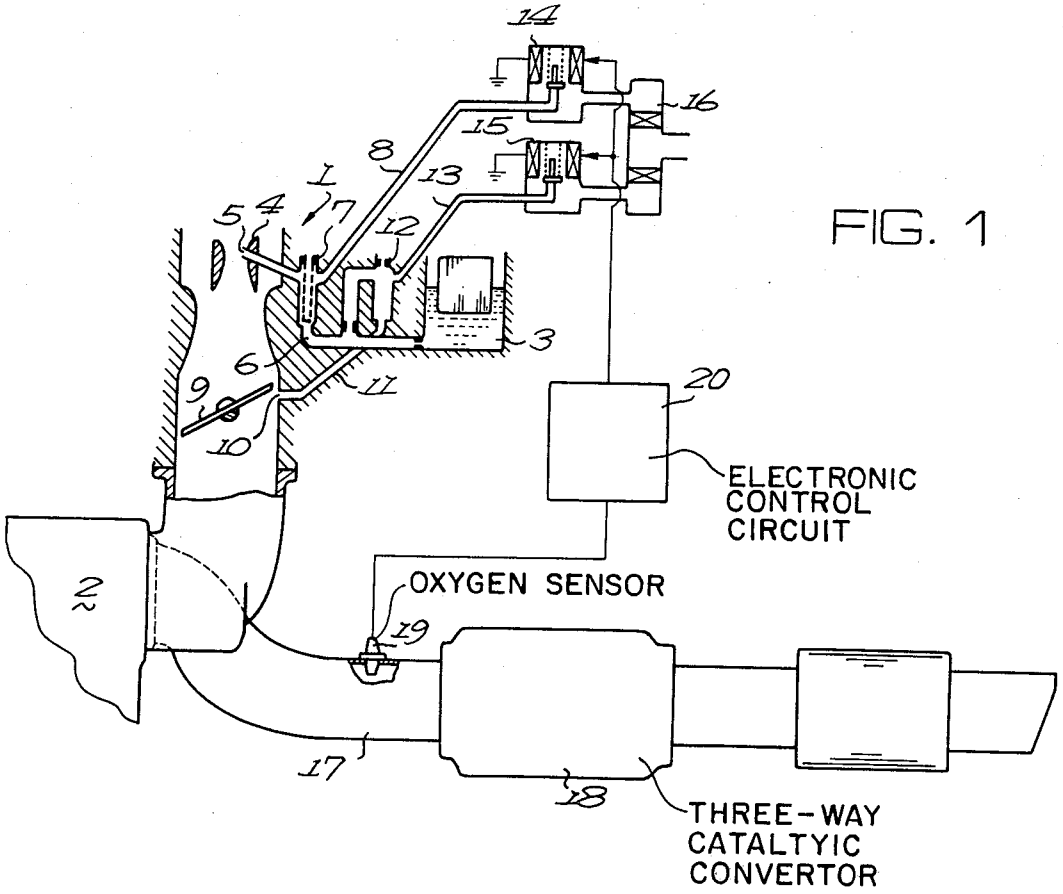
FIG. 1 is a schematic view of a system according to the present invention.

Referring to FIG. 1, a carburetor 1 communicates with an internal combustion engine 2. The carburetor 1 comprises a float chamber 3, a venturi 4 formed in an intake passage, a nozzle 5 communicating with the float chamber 3 through a main fuel passage 6, and a slow port 10 provided near a throttle valve 9 in the intake passage communicating with the float chamber 3 through a slow fuel passage 11. Air correcting passages 8 and 13 are disposed in parallel to a main air bleed 7 and a slow air bleed 12, respectively. On-off type electromagnetic valves 14 and 15 are provided for the air correcting passages 8 and 13, respectively. Inlet ports of each on-off electromagnetic valve 14 and 15 respectively communicates with the atmosphere through an air filter or air cleaner 16. An oxygen sensor 19 is disposed in an exhaust pipe 17 which communicates with the internal combustion engine. The sensor 19 detects the oxygen content of exhaust gases. A three-way catalytic converter 18 is provided in the exhaust pipe 17 downstream of the oxygen sensor 19. The output signals of the oxygen sensor 19 is applied to an electronic control circuit 20 of an electronic control system. The electronic control circuit 20 operates so as to correct the air-fuel ratio of the air-fuel mixture provided by the carburetor 1.

Figure 2:
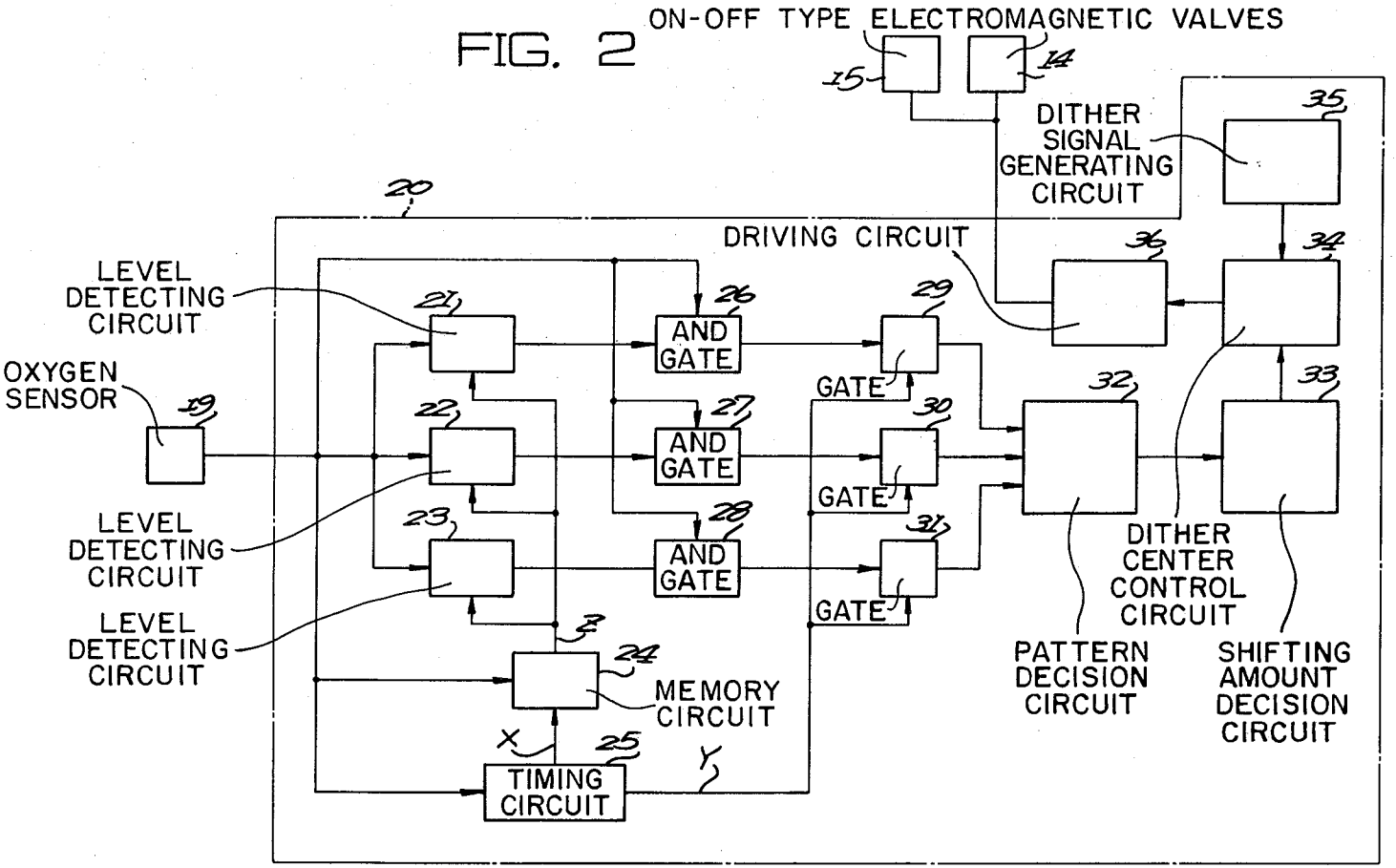
FIG. 2 is a block diagram of an electronic control circuit of the system.

FIG. 2 shows the block diagram of the electronic control circuit 20.

The output of the oxygen sensor 19 is connected to level detecting circuits 21, 22 and 23, to a memory circuit 24, timing circuit 25, and to AND gates 26, 27 and 28. Outputs of the level detecting circuits 21, 22 and 23 are connected to corresponding AND gates 26, 27 and 28, respectively. Outputs of the AND gates 26, 27 and 28 are connected to corresponding gates 29, 30, and 31. Timing signals X and Y are applied to the memory circuit 24 and to the gates 29, 30 and 31 as control signals. The output Z of the memory circuit 24 is applied to level detecting circuits 21, 22 and 23. Outputs of the gates 29, 30 and 31 are connected to a pattern decision circuit 32, the output of the circuit 32 in turn being connected to a shifting amount decision circuit 33 which determines a shifting amount. The output of the shifting amount decision circuit 33 which determines and the output of a dither signal generating circuit 35 are applied to a dither center control circuit 34. The circuit 35 generates a pulse train comprising a dither wave pattern as shown in the lower portion of FIG. 5. The output of the dither center control circuit 34 is connected to the electromagnetic valves 14 and 15 through a driving circuit 36 which produces a valve driving signal as shown in the upper portion of FIG. 5. The duty ratio of the driving pulses from the driving circuit 36 varies in dependency on the level of the dither signal detected by the oxygen sensor 19 for correcting the air-fuel ratio of the mixture to be supplied to the engine 2 to the stoichiometric value.

When the dither signal detected by the oxygen sensor 19 is located within a range of stoichiometry, it is not necessary to shift the center of the dither wave to be applied to the electromagnetic valves 14 and 15. However, when the dither signal detected by the oxygen sensor 19 deviates to the rich or lean side from the stoichiometry during accleration or deceleration of the engine, the dither wave is shifted in the opposite direction to rapidly correct the deviation of the air-fuel ratio. In accordance with the present invention, the amount of the shifting of the dither wave is controlled in dependency on the deviation of the detected dither signal for rapid correction of the deviation in the transient state.

Figure 3:
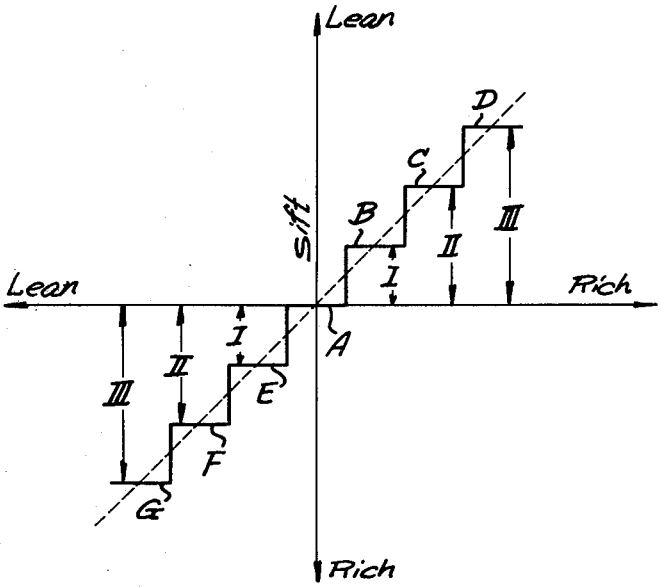
FIG. 3 shows a relationship between patterns of the detected dither signal and the amount of shifting of the signal.

FIG. 3 shows a relationship between patterns of deviation of the detected dither signal and the amount of the shifting to be performed. The patterns of deviation are classified into seven patterns A–G. The amount of shifting varies stepwise according to the pattern. To classify the detected dither signal by the seven patterns, the detected dither signal is compared with a dither signal which is detected after a predetermined period for detecting the deviation rate and direction of the dither signal.

The pattern A is for the steady state of the engine operation, patterns B, C and D are for the transient state for shifting to the lean side and patterns E, F and G are for shifting to the rich side.

The amplitude of the output signal of the oxygen sensor 19 is limited within a maximum amplitude and the bottom of the maximum wave by definition is assumed to be 0% and the peak of the wave is assumed to be 100% which correspond to duty ratios 0% and 100% for the on-off type electromagnetic valve, and therefore 50% corresponds to the stoichiometric value. The level detecting circuit 21 detects whether the output signal from the oxygen sensor 19 deviates by 80% of the level of the output Z from the memory circuit 24. The level detecting circuit 22 detects whether the dither signal deviates by 50% of the level of the output Z and the level detecting circuit 23 detects the output signal of 20% deviation.

The output signal of the oxygen sensor 19 is applied to level detecting circuits 21, 22 and 23, memory circuit 24 and timing circuit 25. The timing circuit 25 produces timing signals X and Y at the peak of the detected dither signal from the oxygen sensor 19. The memory circuit 24 memorizes the level of the output of the oxygen sensor 19 upon receiving the timing signal X. Thus, the memory circuit 24 stores the peak value of the output of the oxygen sensor 19 and produces the memorized level as a memory signal Z by a timing signal X after 1 or 2 pulses. Thus, a new detected dither signal from the oxygen sensor 19 and the old memorized dither signal are applied to the level detecting circuits 21–23. The level detecting circuit 21 passes the detected signal over 80% of the level of the memory signal Z, the level detecting circuit 22 passes the detected signal over 50% and the level detecting circuit 23 passes the detected signal over 20%.

Figure 4A:
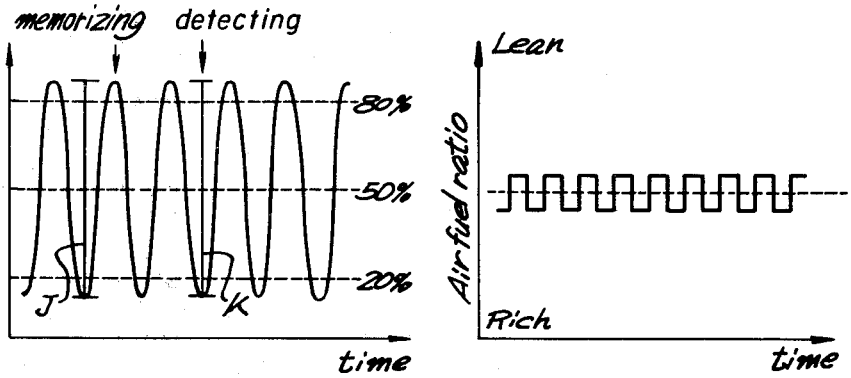
FIGS. 4(A) to 4(G) show detected dither signal (left curves) and shifting of the dither signal (right curves)

FIGS. 4(A) to 4(G) show the dither signal detected by the oxygen sensor 19 and the amount of shift of the dither signal. FIG. 4(A) shows the dither signal (pattern A) in the steady state of the engine operation without acceleration and deceleration. The level of the signal (the amplitude J from the bottom to the peak) at memorizing is equal to the level (the amplitude K) at detecting. Therefore, all level detecting circuits 21, 22 and 23 produce outputs and hence all AND gates 26, 27 and 28 produce outputs respectively. Gates 29, 30 and 31 produce outputs at the timing signal Y which is generated at the peak of the output of the oxygen sensor 19. The pattern decision circuit 32 detects the pattern A by the outputs of gates 29, 30 and 31 to produce the output corresponding to pattern A. When the pattern A is detected, the shifting of the dither wave is not effected.

Figure 4B:
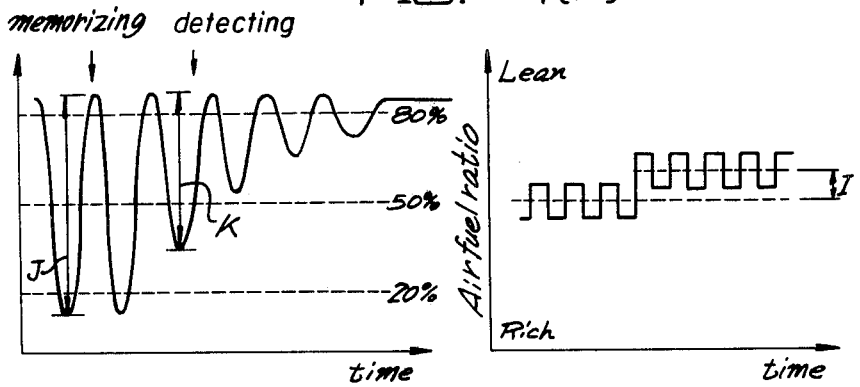

FIG. 4(B) shows the pattern B, in which the amplitude K crosses levels of 50% and 80%. Thus, gates 29 and 30 produce outputs so that the pattern decision circuit 32 detects the pattern B. The detected dither signal of the pattern B deviates to the rich side from the stoichiometric line 50%. Therefore, the circuit 32 is designed so as to produce an output for shifting the dither signal to the lean side. The shifting amount decision circuit 33 produces an output to shift the dither signal by "I" to the lean side (high level) in accordance with the signal from the circuit 32. The dither center control circuit 34 operates to shift the dither signal from the circuit 35 in dependency on the signal from the circuit 33. The shifted dither signal is fed to the electromagnetic valves 14 and 15 through the driving circuit 36.

Figure 5:
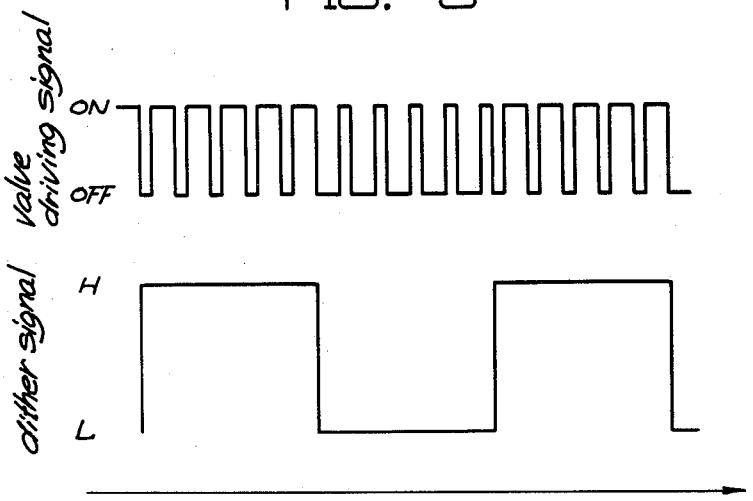
FIG. 5 shows relationship between the dither signal and the duty ratio of the pulses for driving the electromagnetic valve.

FIG. 5 shows the relationship between the level of the dither signal and the duty ratio of the pulses which drive the the electromagnetic valves. When the level of the dither signal is high, the duty ratio is large, which means that the opening period of the valve is increased so as to dilute the air-fuel mixture. Thus, the deviation of the air-fuel ratio to the rich side may rapidly converge to the stoichiometric value.

Figure 4C:
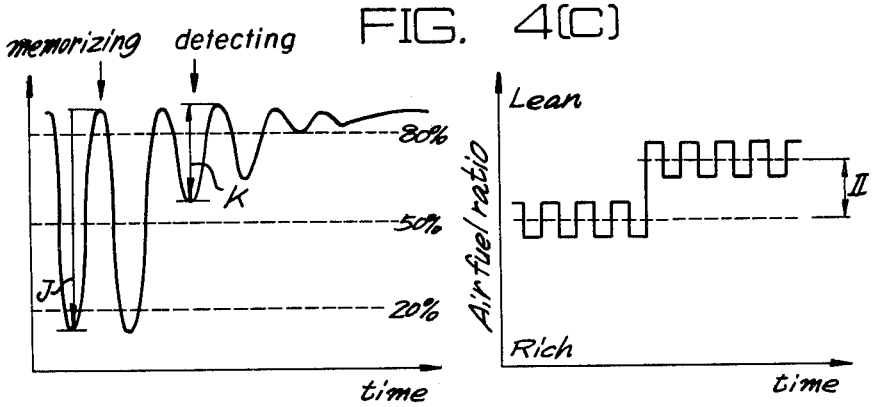
Figure 4D:
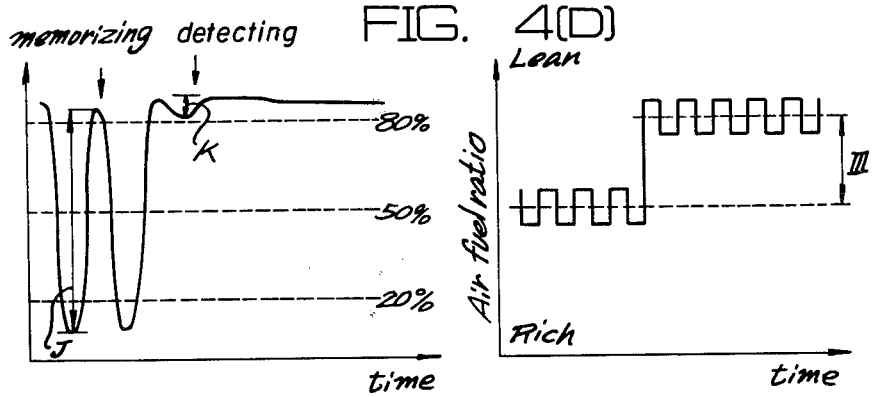

When the patterns C and D shown in FIGS. 4(C) and 4(D) are detected, operation similar to the above operation is effected. The dither signal is shifted by "II" and "III" at the patterns C and D, respectively.

Figure 4E:
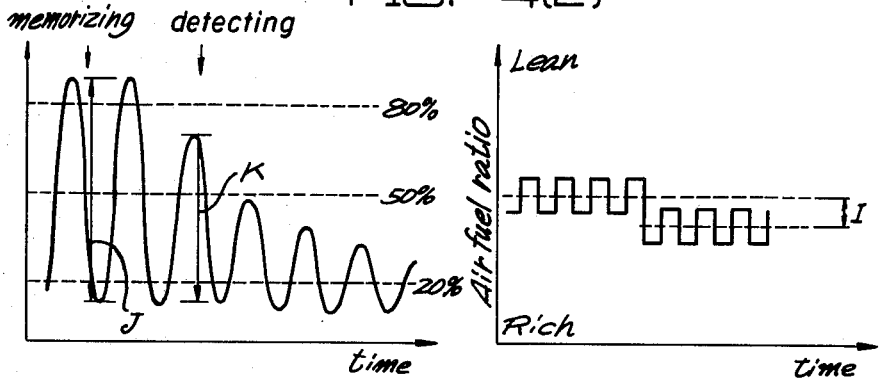
Figure 4F:
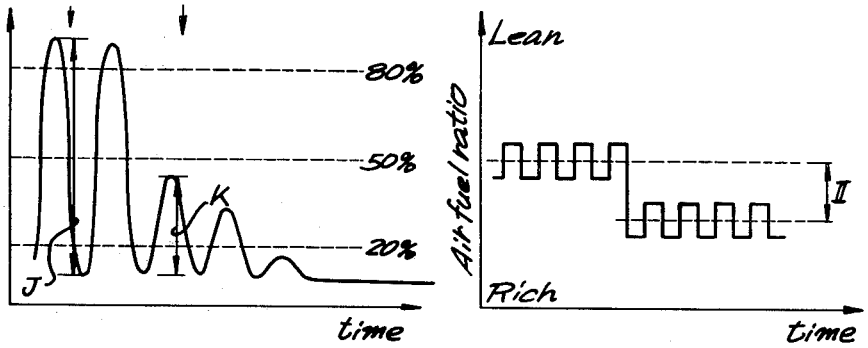
Figure 4G:
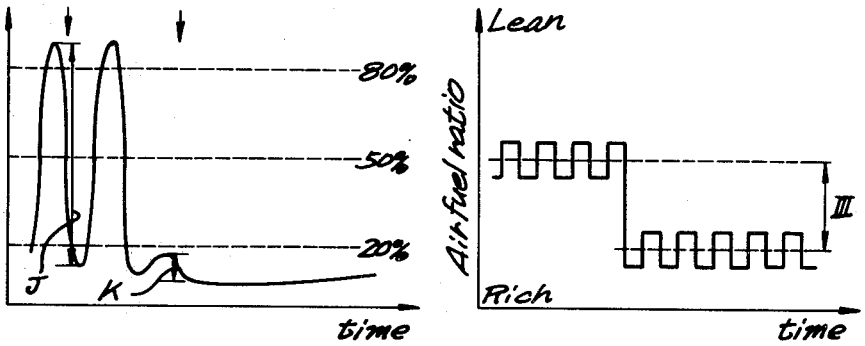

FIGS. 4(E), 4(F) and 4(G) show patterns E, F and G which mean that the detected dither signal deviates to the lean side. Therefore, the system operates to shift the center of the dither signal to the rich side. More particularly, when pattern E occurs, only gates 30 and 31 produce outputs, so that the circuit 32 generates a pattern E signal and the shifting amount decision circuit 33 produces a signal for shifting I to the rich side. At other patterns F and G, similar control to the pattern E is carried out.

Thus, in accordance with the present invention, the dither signal is shifted by an amount suitable to correct the deviation of the air-fuel ratio in dependency on the transient state of the engine operation, such that the deviation may quickly converge to the stoichiometric air-fuel ratio.

Figure 6:
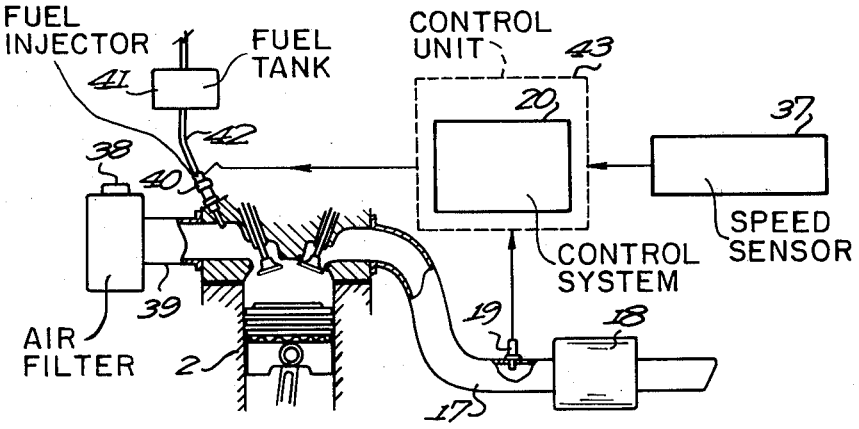
FIG. 6 shows another embodiment of the present invention.
Figure 7A:
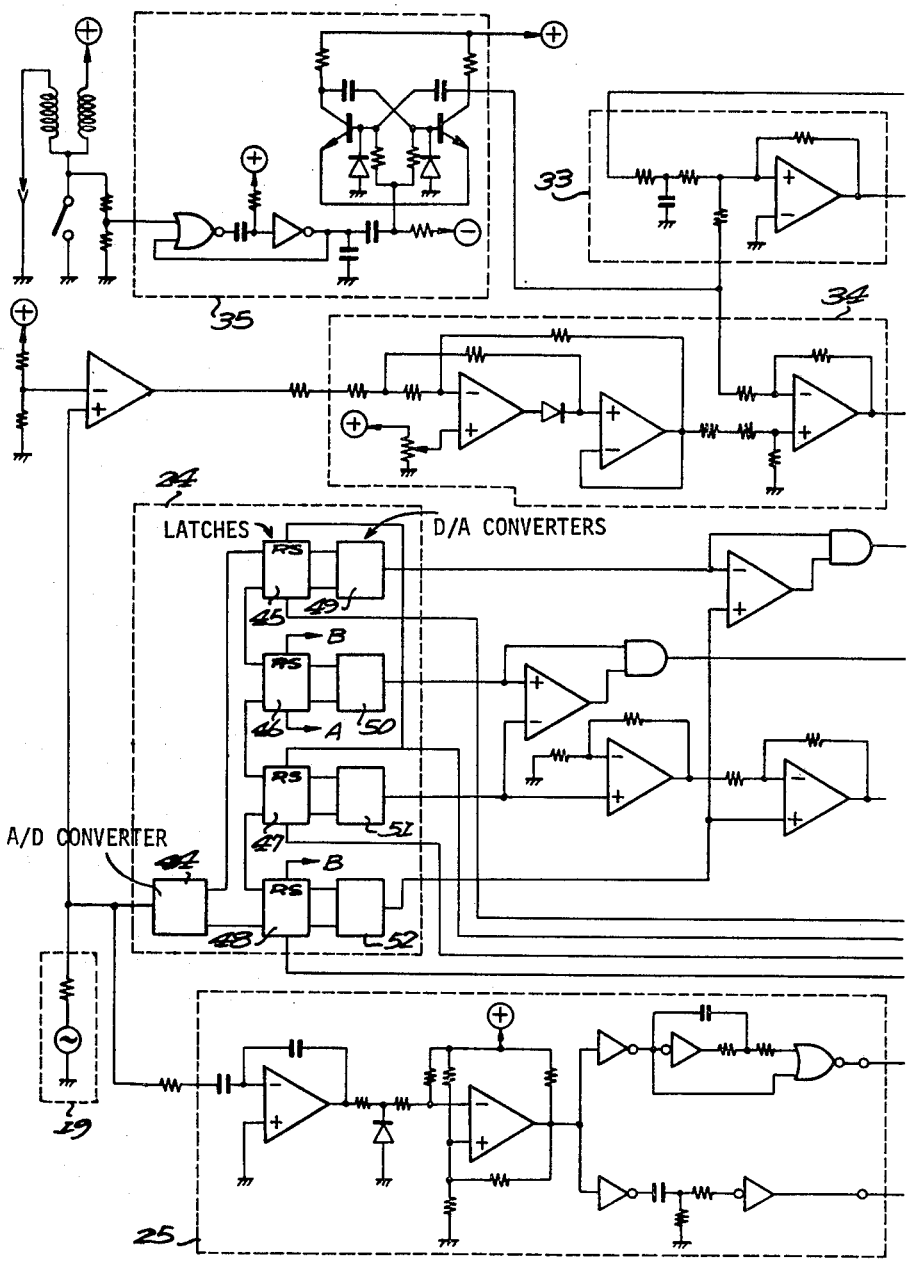
Figure 7B:
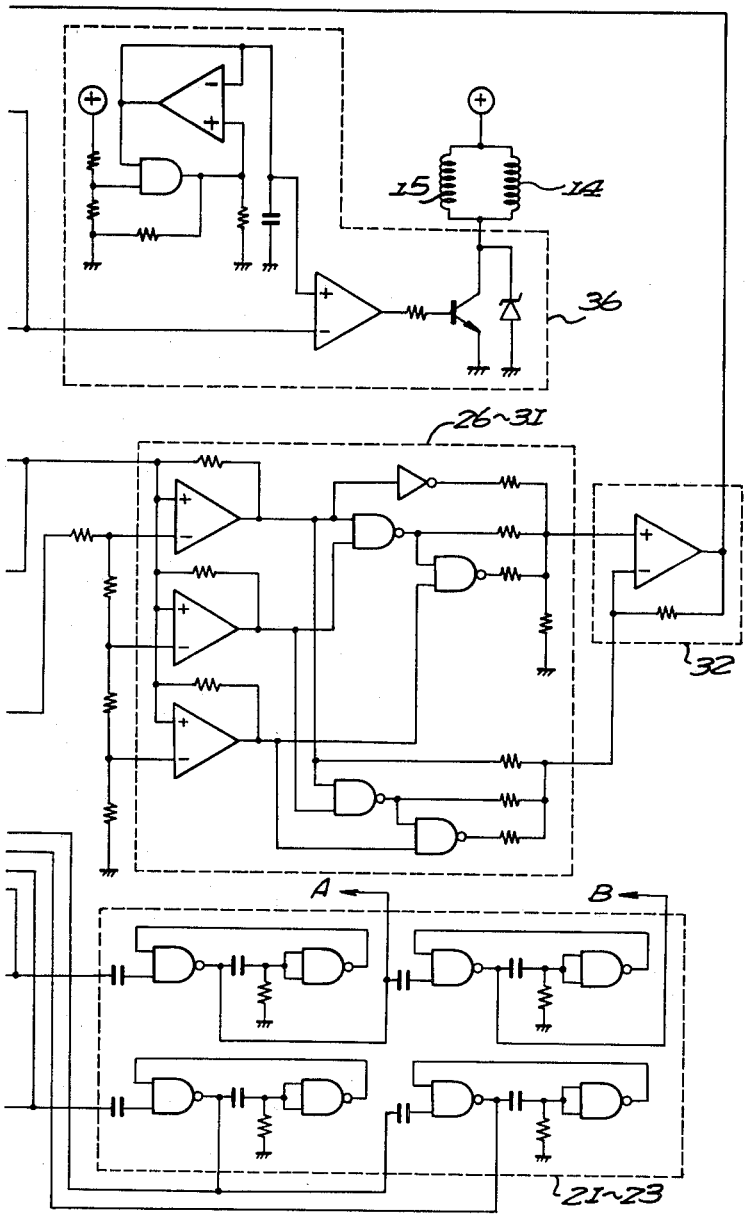

FIG. 6 shows another embodiment, in which the present invention is applied to an engine provided with a fuel injection system. A fuel injector 40 is provided on an intake manifold 39 downstream of an air filter 38. The fuel injector 40 communicates through a conduit 42 with a fuel tank 41 having a fuel pump (not shown). The fuel injector 40 is operatively connected to a control unit 43 having the control system 20 of FIG. 2. The oxygen sensor 19 and a speed sensor 37 are provided for controlling the control system 20. In such a system, the fuel injector 40 is operated by the dither signal in the same manner as the previous embodiment, so that effective emission control may be performed.

FIGS. *7a* and *7b* show an example of the electronic control circuit in which the same parts as in FIG. 2 are identified by similar reference numbers. The memory circuit 24 is composed of digital memory circuits. Consequently, the memory circuit 24 comprises an analog-to-digital converter 44, latches 45–48, and digital-to-analog converters 49–52.

What is claimed is:

1. In an air-fuel ratio control system for an internal combustion engine having an intake passage and an exhaust passage, air-fuel mixture supply means for supplying the air-fuel mixture to the engine, on-off type electromagnetic valve means for correcting the air-fuel ratio of the air-fuel mixture supplied by said air-fuel mixture supply means, the improvement comprising dither signal generating circuit means for producing a periodical dither signal having a waveform, a shift control circuit means for shifting the level of the center of said dither signal, driving circuit means operatively connected to said shift control circuit means for producing a driving output according to said dither signal and for driving said on-off type electromagnetic valve means, detecting means for detecting the concentration of oxygen in exhaust gases passing through said exhaust passage, a memory circuit means for memorizing a peak level of output of said detecting means and for producing an output according to the memorized peak level, first circuit means being applied with outputs of said detecting means and of said memory circuit means for detecting deviation of the dither signal detected by said detecting means, decision circuit means responsive to outputs of said first circuit means for producing a decision output representing the direction and amount of deviation of the detected dither signal from a stoichiometric air-fuel ratio, second circuit means responsive to said decision output of said decision circuit means for controlling said shift control circuit means dependent on said decision output of said circuit means in such a manner that the deviation of said dither signal is corrected to the stoichiometric air-fuel ratio.

2. The system as set forth in claim 1, wherein said second circuit means is for producing an output signal for deciding direction and amount of the shifting of said dither signal by the shift control circuit means such that the deviation of said dither signal is corrected to the stoichiometric air-fuel ratio.

3. The system as set forth in claim 1, wherein said first circuit means comprises a plurality of level detecting circuits.

4. The system as set forth in claim 3, wherein each of said plurality of level detecting circuits constitutes means for detecting deviation of the dither signal detected by said detecting means with respect to a different detecting level with respect to said memorized peak level from the detecting level of the others of said plurality of level detecting circuits and for comparing said detected dither signal with said detecting level, respectively.

5. The system as set forth in claim 4, wherein said decision circuit means is responsive to various combinations of the outputs of said level detecting circuits for producing said decision output respectively dependent on said various combinations of the outputs of said level detecting circuits representing the direction and amount of deviation of the detected dither signal from the stoichiometric air-fuel ratio.

* * * * *